United States Patent [19]

Clowers

[11] 4,008,505

[45] Feb. 22, 1977

[54] ABOVE-THE-FLOOR ADAPTOR FOR UPRIGHT VACUUM CLEANERS

[75] Inventor: Earl R. Clowers, Anderson, S.C.

[73] Assignee: The Singer Company, New York, N.Y.

[22] Filed: May 27, 1975

[21] Appl. No.: 580,999

[52] U.S. Cl. ..... 15/338

[51] Int. Cl.[2] ..... A47L 5/32

[58] Field of Search ..... 15/338

[56] References Cited

UNITED STATES PATENTS

| | | | |
|---|---|---|---|
| 1,708,282 | 4/1929 | Serva | 15/338 |
| 1,773,961 | 8/1930 | Dance | 15/338 X |
| 1,920,621 | 8/1933 | Allen | 15/338 |
| 2,871,504 | 2/1959 | Gall et al. | 15/338 |
| 2,996,748 | 8/1961 | Gitzendanner | 15/338 |

FOREIGN PATENTS OR APPLICATIONS

| | | | |
|---|---|---|---|
| 337,202 | 10/1930 | United Kingdom | 15/338 |

*Primary Examiner*—Christopher K. Moore
*Attorney, Agent, or Firm*—Edward L. Bell; Robert E. Smith; Alan Ruderman

[57] ABSTRACT

An adaptor for converting an upright vacuum cleaner for use as an above-the-floor cleaner. The adaptor includes an open ended housing which is removably fitted over the front of the cleaner chassis and includes an air chamber communicating the cleaner nozzle opening with one extremity of a hose. The adaptor includes yieldable gripping members for engagement with the upper surface of the cleaner chassis. It also includes camming tabs and resilient fingers spaced apart across the outlet opening of the air chamber for entry into the cleaner nozzle to secure the adaptor laterally while the gripping members draw the adaptor tightly against the cleaner nozzle.

6 Claims, 5 Drawing Figures

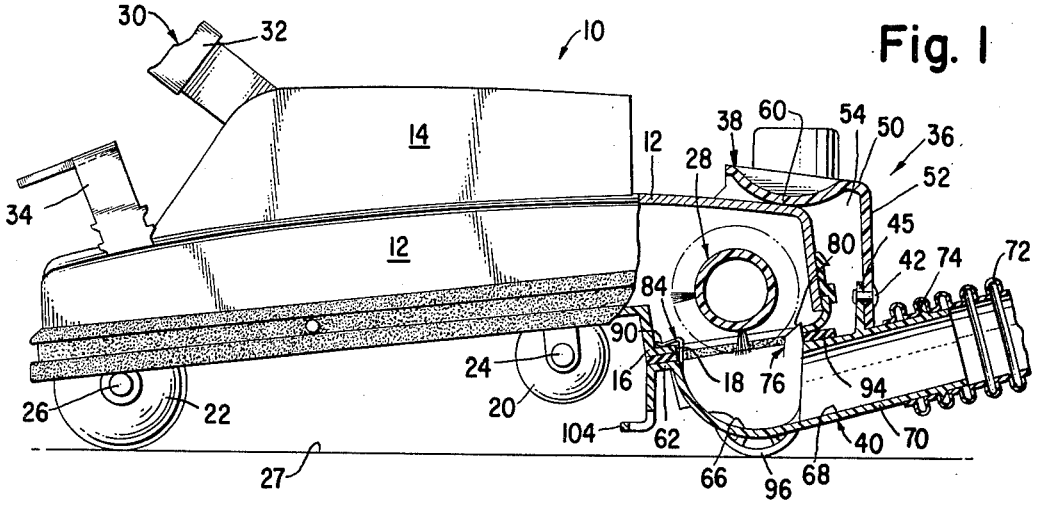
Fig. 1
Fig. 2
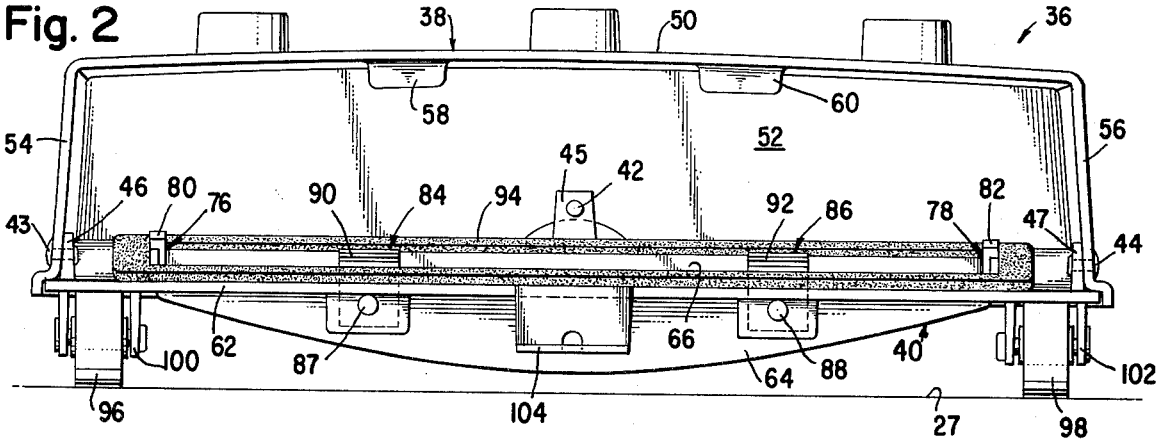
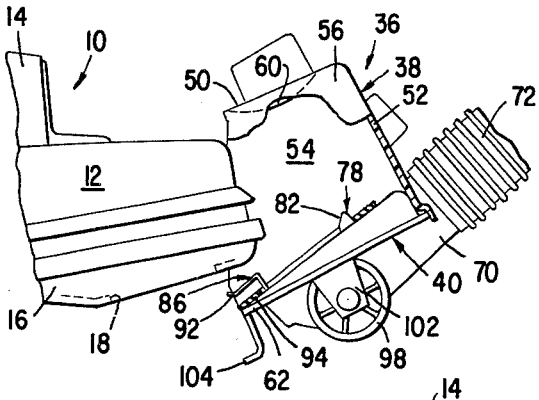
Fig. 3
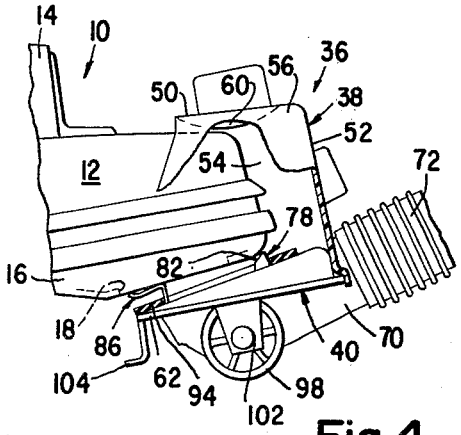
Fig. 4
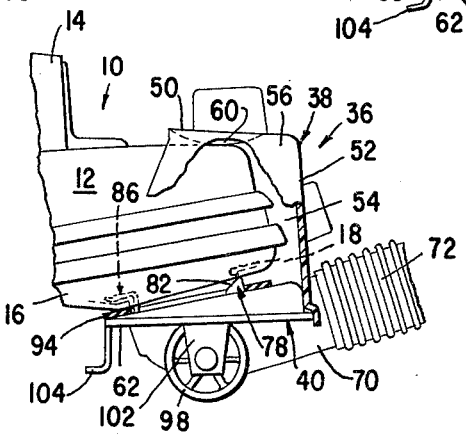
Fig. 5

ABOVE-THE-FLOOR ADAPTOR FOR UPRIGHT VACUUM CLEANERS

BACKGROUND OF THE INVENTION

This invention relates to vacuum cleaners and more particularly to an adaptor attachable to upright vacuum cleaners to permit a flexible hose and extension tools to be connected to the nozzle mouth of the cleaner for above-the-floor cleaning.

Vacuum cleaners of the upright variety generally include a chassis having an elongated nozzle mouth or opening at the bottom thereof through which air is sucked by an air moving motor-fan unit, a rotary brush mounted adjacent to the nozzle mouth for contacting a floor surface to agitate and loosen the dirt so that it may be sucked free of the surface, wheels for rolling the cleaner on the floor and a handle for guiding and propelling the cleaner. Most common household cleaning chores involve the cleaning of carpeting, and an upright cleaner is best for such usage. However, in those instances where above-the-floor cleaning of such items as furniture, walls, ceilings, and drapery or the like is required, a conventional upright cleaner is useless. The typical vacuum cleaner for such cleaning is a canister type which includes a hose having one extremity leading to a suction chamber and the other exremity adapted to receive a plurality of interchangeable accessory nozzles.

In order to minimize the need for a household to have these two types of cleaners, the prior art has attempted various approaches of converting one type of cleaner to the use usually reserved to the other type. For example, canister cleaners having means for accepting a power brush attachment for the cleaning of floors is well-known. Moreover, adaptors for attachment to an upright vacuum cleaner to convert to above-the-floor cleaning is also known. Examples of the known prior art in this latter area are U.S. Pat. Nos. 1,021,731; 1,184,201; 1,227,142; 1,648,466; 1,673,920; 1,920,621; 2,606,336; 2,871,504; and 2,996,748. The adaptors disclosed in each of these prior art patents mount on the bottom of the upright cleaner in underlaying substantially sealed relation with the nozzle mouth to communicate a hose with the cleaner suction chamber. A disadvantage of these known prior art units is that they are difficult to install and secure on the cleaner chassis. Special brackets have generally been used to prevent loosening of the adaptors due to vibration when the cleaners are operating.

SUMMARY OF THE INVENTION

In order to overcome these deficiencies of the prior art adaptors the present invention provides an adaptor that readily slides onto the upright cleaner chassis to adapt the cleaner for above-the-floor cleaning. The adaptor includes a housing having locking members which coact with the leading and trailing edges of the cleaner nozzle mouth, and a yieldable projection for engaging the upper surface of the cleaner chassis. The spacing between the yieldable projection and at least some of the locking members is less than the comparable distance between the upper surface of the chassis and the lower surface within which the nozzle mouth is found so that locking members are drawn into locking relationship with the nozzle mouth when the adaptor housing is contiguous with the lower surface.

Accordingly, it is therefore a primary object of the present invention to provide an adaptor which can be readily placed on an upright cleaner for converting to above-the-floor cleaning and which can be readily removed therefrom.

Another object of this invention is to provide an attachment adaptor for upright vacuum cleaners which can be slidably connected on or disconnected from the cleaner chassis.

A further object of this invention is to provide a vacuum cleaner converter attachment positioned over the nozzle mouth and the cantilevered front portion of an upright vacuum cleaner for converting the cleaner to above-the-floor cleaning.

BRIEF DESCRIPTION OF THE DRAWINGS

Other objects and advantages of this invention will best be understood upon reading the following detailed description of the invention with the accompanying drawings, in which:

FIG. 1 is a fragmentary side elevational view partly in section of an upright vacuum cleaner including the adaptor of the present invention in operative position thereon;

FIG. 2 is an elevational view of the adaptor illustrated in FIG. 1 viewed from the open end; and FIGS. 3 – 5 are diagrammatic views illustrating the procedure for installing the adaptor on the vacuum cleaner.

DESCRIPTION OF THE PREFERRED EMBODIMENT

Referring now to the drawing there is illustrated an upright vacuum cleaner 10 including a chassis 12, on the top of which is secured a hood 14. In a conventional manner, a motor and fan impellers (not shown) are mounted in the chassis below the hood. The cleaner includes an access plate 16 having a nozzle inlet mouth 18 releasably secured to the bottom of the chassis which communicates the dirt laden air with the fan impellers. A cleaner of this type is illustrated in U.S. Pat. Nos. 3,716,185 and 3,163,439 which are assigned to the assignee of the present invention and to which patents reference may be had for a full disclosure of the vacuum cleaner. The fan impellers communicate through a discharge duct between the chassis, the access plate 16 and the hood with a dust bag assembly as illustrated in the aforesaid patents. A pair of front 20 and rear 22 wheels (only one of each pair being illustrated) are respectively mounted on axles 24 and 26 supported on the underside of the chassis to support the cleaner on a floor surface 27. A rotary floor brush assembly 28 is mounted at the front of the cleaner in the nozzle above the mouth 18 so as to contact the floor surface when the cleaner is used as a conventional upright cleaner. It may be noted that the front portion of the cleaner chassis forward of the wheels 20 comprises a cantilevered portion. Propulsion and manipulation of the cleaner is attained through a handle 30 pivotably connected to the upper side of the chassis by a bifurcated bail member 32. The chassis, and thus the nozzle mouth and brush, may be adjusted relative to the floor by means of a lever 34 connected to the rear wheels 22 as disclosed in co-pending U.S. Patent Application Ser. No. 424,510 filed Dec. 13, 1973 and assigned to the assignee of the present application.

In order to convert the upright vacuum cleaner for above-the-floor cleaning the present invention provides an adaptor including a housing 36. The housing 36 may preferably comprise two parts, an upper portion 38, which may be a polystyrene plastic, and a lower portion 40, which may be a polycarbonate plastic. The two parts 38 and 40 can be secured together as by bonding, and/or by means of rivets 42, 43 and 44 securing one of the parts, e.g., upper portion 38, to respective lugs 45, 46 and 47 molded on the other part, e.g., lower portion 40. The upper portion 38 includes a top wall 50, a front wall 52, and a pair of opposite facing end walls 54 and 56 all of which are integrally interconnected. Recessed inwardly from the top wall 50 so as to form projections extending from the inner surface thereof are a pair of protuberances 58 and 60 defining gripping pads, the function of which will hereinafter be described. The wall 50 is relatively thin so a small force applied to the pads 58 and 60 will cause the wall to elastically yield, especially where, as preferred, the wall 50 comprises a plastic of limited elasticity.

The lower portion 40 comprises a base plate 62 having the central portion thereof convexly outwardly at 64 away from the upper portion 38 so as to define a cavity 66 forming an air chamber. Formed in the front central portion of the cavity 66 is an aperture 68 about which an annular boss 70 may be molded. A flexible hose 72 may be fitted about a ridge 74 formed on the boss 70 to communicate a conventional accessory nozzle (not shown) on the free end of the hose with the cavity 66.

Located on the plate 62 at the front edge of the cavity 66 preferably adjacent each end thereof is a respective locking tab 76 and 78. The tabs project upwardly above the base plate and have respective camming surfaces 80 and 82 formed on the tops thereof which extend obliquely from the front to the rear of each tab. The vertical spacing between the top of the tabs and the bottom of the gripping pads 58 and 60 is less than the spacing between the access plate 16 of the cleaner chassis to the top surface of the chassis for reasons hereafter described. A pair of spaced preferably metallic clips 84 and 86 are attached at the rear edge of the cavity 66 by means of, for example, rivets 87 and 88. The clips conform in shape to the rear edge of the cavity against which it extends upwardly above the base plate 62, and thereafter are bent so as to have rearwardly extending fingers 90 and 92 respectively. The construction and mounting of the clips are such that the fingers 90 and 92 are resiliently mounted and may readily bend about the mounting rivet upon exertion of a force on the ends thereof. As hereinafter explained, the tabs 76 and 78, and the clip fingers 90 and 92, respectively engage the front or leading edge of the nozzle mouth and the rear or trailing edge of the nozzle mouth to secure the adaptor laterally to the vacuum cleaner chassis. A gasket 94, preferably rubber, is positioned on the base plate 62 about the cavity 66 to provide a seal between the nozzle mouth 18 and the border of the cavity to prevent leakage of air into the vacuum cleaner. Thus, the suction of the cleaner acts to pull air in only through the hose 72.

For ease of pulling the cleaner when operated during the above-the-floor mode, there is provided a pair of wheels 96 and 98 journaled on axles mounted in bifurcated brackets 100 and 102 mounted on the under surface of the base plate 62. When the adaptor is attached the front of the cleaner is raised so that the weight is distributed on the rear wheels 22 and the wheels 96 and 98. This tends to distribute the weight of the forward part of the cleaner evenly around the seal 94. This, combined with the force on the outside surface of the adaptor base plate by the pressure differential when the cleaner is operating, effects an air tight assembly. A bracket 104 may be mounted on the rear of the adaptor for hanging in an out-of-the-way place when the adaptor is not in use.

To assemble the adaptor to the cleaner, the front of the cleaner chassis is lifted slightly off the floor and is directed into the open end of the adaptor which is tilted slightly as illustrated in FIG. 3. The sides and top of the upper portion serve to guide the adaptor onto the cleaner chassis. There is no resistance until the cleaner enters the adaptor at the point where the gripping pads 58 and 60 and the locking tabs 80 and 82 engage the upper surface of the chassis 12 and the access plate 16 respectively as illustrated in FIG. 4. From this point the distance between the locking tabs and the gripping pads is less than the comparable distance between the access plate and the top of the chassis. As the cleaner is inserted further into the adaptor, as illustrated in FIG. 5, the chassis forces the gripping pads 58 and 60 upwardly which in turn increases the distance between the gripping pads and the locking tabs 80 and 82 permitting the locking tabs to pass under the access plate 16. The fingers 90 and 92 of the clips 84 and 86 enter the nozzle mouth 18 in the access plate 16 and pass over the inner surface of the rear edge of the nozzle mouth. The adaptor is further pushed onto the chassis pivoting about the fingers 90 and 92 until the locking tabs 80 and 82 snap into the front of the nozzle mouth opening. The spacing between the pads 58 and 60 and the base plate 62 is substantially the same as the spacing between the top surface of the chassis 12 and the lower surface of the access plate 16 so that the gripping pads 58 and 60 exert a pressure against the chassis while the gasket 94 engages the plate about the nozzle mouth. The fingers 90 and 92 are spaced from the locking tabs 76 and 78 a distance equal to the lateral spacing of the nozzle mouth so that in the secured position of FIG. 1 these members prevent lateral movement of the adaptor relative to the cleaner. Moreover, the gripping pads 58 and 60 exert a slight pressure against the chassis so that the locking members i.e., the tabs 76 and 78 and the fingers 90 and 92 are drawn into the nozzle mouth to secure the adaptor firmly on the vacuum cleaner chassis. With this construction the locking tabs 76 and 78 will not disengage from the access plate when a forward and/or upward force is exerted on the cleaner by manipulation of the hose 72. The fingers sitting over the rear edge of the nozzle mouth and the slight force exerted on the top of the chassis by the gripping pads prevent an accidental disengagement of the adaptor when the front of the cleaner is lifted from the floor.

Removal of the adaptor is accomplished by using a forward turning or tilting motion on the adaptor assembly while holding the front of the cleaner stationary. A force to the top and front of the adaptor that is directed forwardly and downwardly will cause the adaptor assembly to pivot at the point where the fingers 90 and 92 fit the rear of the nozzle mouth opening while the locking tabs 76 and 78 move downwardly to clear the front of the nozzle mouth opening as illustrated in FIG. 5. The adaptor is then pulled forwardly and away from the cleaner as illustrated in FIGS. 4 and 3 respectively.

Numerous alterations of the structure herein disclosed will suggest themselves to those skilled in the art. However, it is to be understood that the present disclosure relates to a preferred embodiment of the invention which is for purposes of illustration only and not be construed as a limitation of the invention. All such modifications which do not depart from the spirit of the invention are intended to be included within the scope of the appended claims.

Having thus described the nature of the invention, what we claim herein is:

1. An attachment adaptor for an upright vacuum cleaner of the type having a casing enclosing a suction chamber, said casing including a cantilevered front portion having an under surface formed with an air opening communicating with said suction chamber and an upper surface spaced from said under surface, said attachment adaptor comprising a housing formed with an air chamber having an air opening and a separate hose connection, complimental interlocking means on said housing and on said vacuum cleaner casing adjacent to the openings therein, yieldable projection gripping means formed on said adaptor housing for engaging the upper surface of said cantilevered front portion when said openings are brought into registry, said yieldable projection gripping means being spaced apart from said interlocking means on said adaptor a distance which is less than that which the upper surface of said vacuum cleaner casing is spaced from the under surface thereof for drawing the complimental interlocking means into interlocking relation when the adaptor is mounted on said vacuum cleaner with said openings in registry.

2. An attachment adaptor as recited in claim 1 wherein said complimental interlocking means includes resilient fingers on said adaptor for entering said cleaner opening for gripping the under surface of said cleaner casing at an edge of the opening, and tabs spaced from said fingers projecting from said adaptor for entering said cleaner opening to engage another edge thereof.

3. An attachment adaptor for an upright vacuum cleaner of the type having a casing enclosing a suction chamber, said casing including a cantilevered front portion having an under surface formed with an air opening communicating with said suction chamber and an upper surface spaced from said under surface, said attachment adaptor comprising a housing having a shape complimental to the cantilevered front portion of the vacuum cleaner casing, said housing including a top wall for overlying said surface, side walls for enclosing said front portion and an air chamber in the housing including at least a bottom portion adapted to underlie said under surface, said bottom portion formed with an outlet opening complimental to the intake opening of said vacuum cleaner casing, means projecting from said attachment adaptor housing adjacent to the periphery of said opening for entry into said vacuum cleaner casing inlet opening, said top wall including yielding gripping means for engagement with said upper surface of said vacuum cleaner casing and effective to draw the projecting means on said adaptor housing into interlocking relation within the intake opening of said vacuum cleaner casing when the attachment adaptor is shifted into contiguous relation on the cantilevered front portion of said vacuum cleaner casing.

4. An attachment adaptor as recited in claim 3 wherein said projecting means comprises at least a tab having a camming surface spaced from said yieldable gripping means a distance which is less than that which the upper surface is spaced from said under surface whereby said camming surface engages the under surface and the yieldable gripping means engages the upper surface when said housing is placed on said front, said cam surface adapted to enter said intake opening upon yielding of said yieldable means upon further insertion of said housing onto said front portion.

5. An attachment adaptor as recited in claim 4 including at least a finger spaced from said tab for entry into said cleaner inlet opening for interlocking with the under surface adjacent said intake opening.

6. An attachment adaptor as recited in claim 5 wherein the spacing between said yieldable gripping means and the periphery of said outlet opening is substantially the same as the distance which the upper surface is spaced from said under surface so that said gripping means exerts a force against said upper surface when said housing is positioned on said front portion.

* * * * *

UNITED STATES PATENT OFFICE

CERTIFICATE OF CORRECTION

PATENT NO. : 4,008,505

DATED : February 22, 1977

INVENTOR(S) : Earl R. Clowers

It is certified that error appears in the above-identified patent and that said Letters Patent are hereby corrected as shown below:

Column 3, line 21 after "thereof" insert -- distended --

Signed and Sealed this

Third Day of May 1977

[SEAL]

*Attest:*

RUTH C. MASON
*Attesting Officer*

C. MARSHALL DANN
*Commissioner of Patents and Trademarks*